United States Patent [19]

Mizelle

[11] Patent Number: 4,651,363

[45] Date of Patent: Mar. 24, 1987

[54] ARTICLES OF FURNITURE AND COMPONENTS THEREOF

[76] Inventor: Ned W. Mizelle, P.O. Box 5985, High Point, N.C. 27262

[21] Appl. No.: 721,603

[22] Filed: Apr. 10, 1985

[51] Int. Cl.[4] ..... A47C 17/04

[52] U.S. Cl. ..... 5/37 R; 5/38; 5/41; 5/47; 5/51 B; 297/440

[58] Field of Search ..... 5/12 R, 18 R, 28, 37–42, 5/47, 48, 51 B, 51 K, 51 M, 57 D, 57 R; 297/340, 416, 440

[56] References Cited

U.S. PATENT DOCUMENTS

| | | | |
|---|---|---|---|
| 2,214,078 | 9/1940 | Feldman | 5/37 R |
| 2,326,196 | 8/1943 | Bell | 5/47 |
| 2,636,187 | 4/1953 | Poskin | 5/38 |
| 2,751,605 | 6/1956 | Sogge | 5/38 |
| 2,847,684 | 8/1958 | Pompon | 5/38 |
| 3,188,134 | 6/1965 | Nixon | 5/48 |
| 3,657,747 | 4/1972 | Rogers, Jr. et al. | 5/37 R |
| 3,973,800 | 8/1976 | Kogan | 297/440 |
| 4,001,901 | 1/1977 | Quakenbush | 5/37 R |

FOREIGN PATENT DOCUMENTS

| | | | |
|---|---|---|---|
| 865959 | 2/1953 | Fed. Rep. of Germany | 5/18 R |
| 586532 | 4/1977 | Switzerland | 5/12 R |

*Primary Examiner*—Gary L. Smith
*Assistant Examiner*—Michael F. Trettel
*Attorney, Agent, or Firm*—Beveridge, DeGrandi and Weilacher

[57] ABSTRACT

A mechanism for a convertible seating/sleeping article of furniture has a base which moves on a floor, a seat support member supported on the base by a scissors linkage, and a back support member which is connected to the seat support member by a first pivot. A back-lowering link is pivotally connected at second and third pivots, respectively, to one of the scissors links and to the back support member. When the mechanism is in its seating configuration, the first pivot is near a line which extends between the second and third pivots to prevent inadvertent movement of the members to their seating positions.

A support leg is pivoted at the rear of the back support member, and a link swings the support leg outwardly when the back support member moves to its sleeping position.

The seat-supporting scissors linkage includes a first link which is in a same vertical plane as the base, and a pair of parallel links which are pivoted to and are on opposite sides of the first link.

When installed in an article of furniture, the seat support members of the mechanisms are connected to a seat frame, and the back support members are connected to a back frame. In one type of sofa, the mechanisms are part of a cushion-supporting assembly which is movable relative to a frame assembly which has a back frame and a side frame for enclosing the rear and sides of the cushion-supporting assembly. In another type of sofa, relative movement between the back and seat support members in the seating position is prevented by connecting them to detachable side arm members.

52 Claims, 16 Drawing Figures

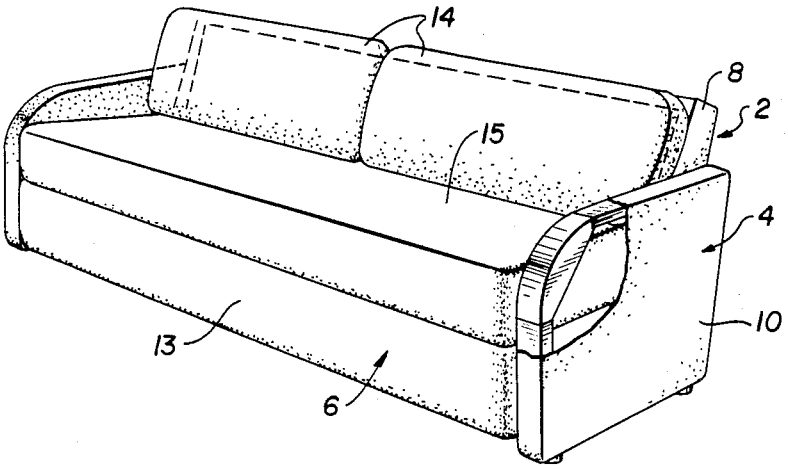
FIG.1
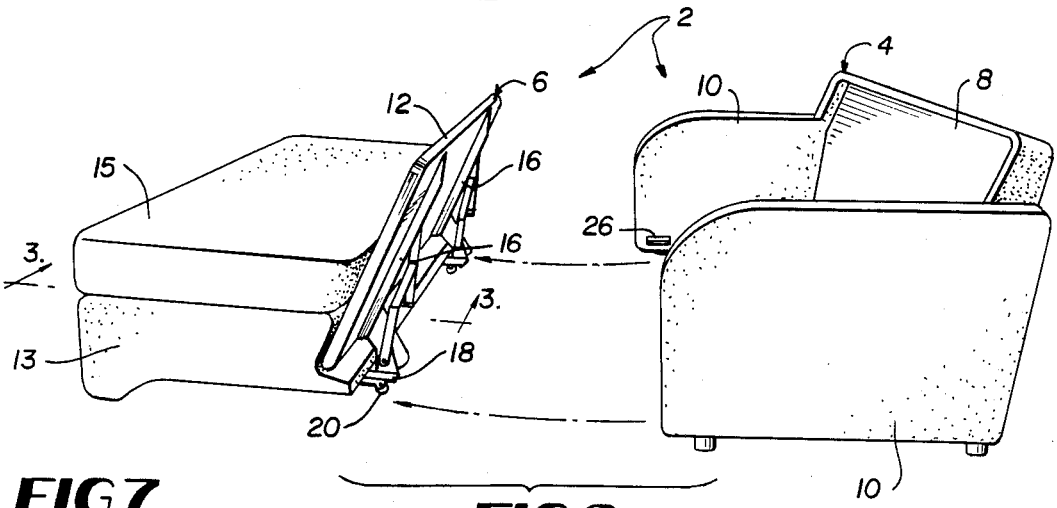
FIG.2
FIG.7
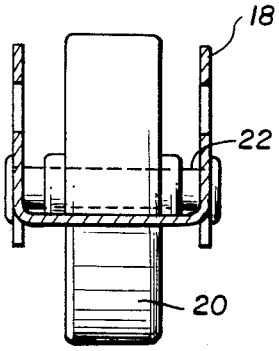
FIG.8
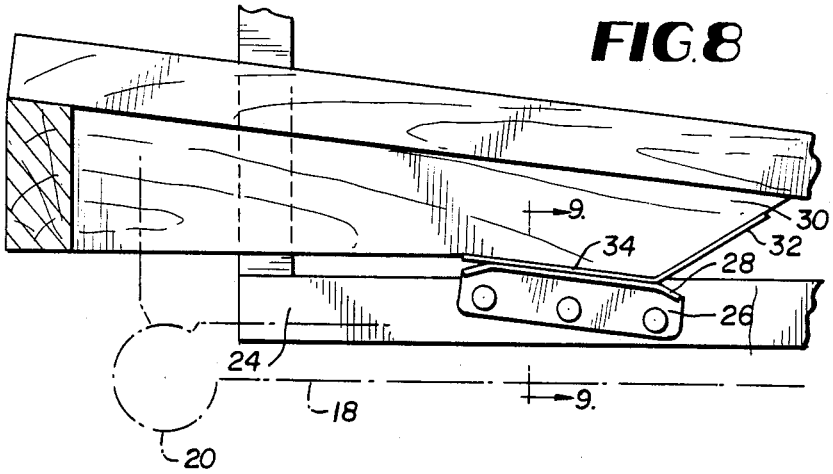
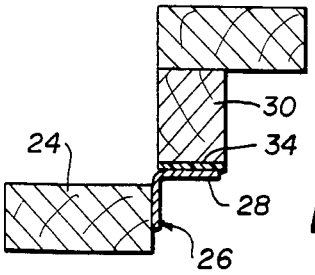
FIG.9

16
18
20
22
36
38
40
42
44
46
48
50
52
54
55
56
58
60
62
66
68
69
70
72
74
76
78
82
84
86
88
90
92
94
110
112
114
116
118
P1
P2
P3
7.

FIG. 6
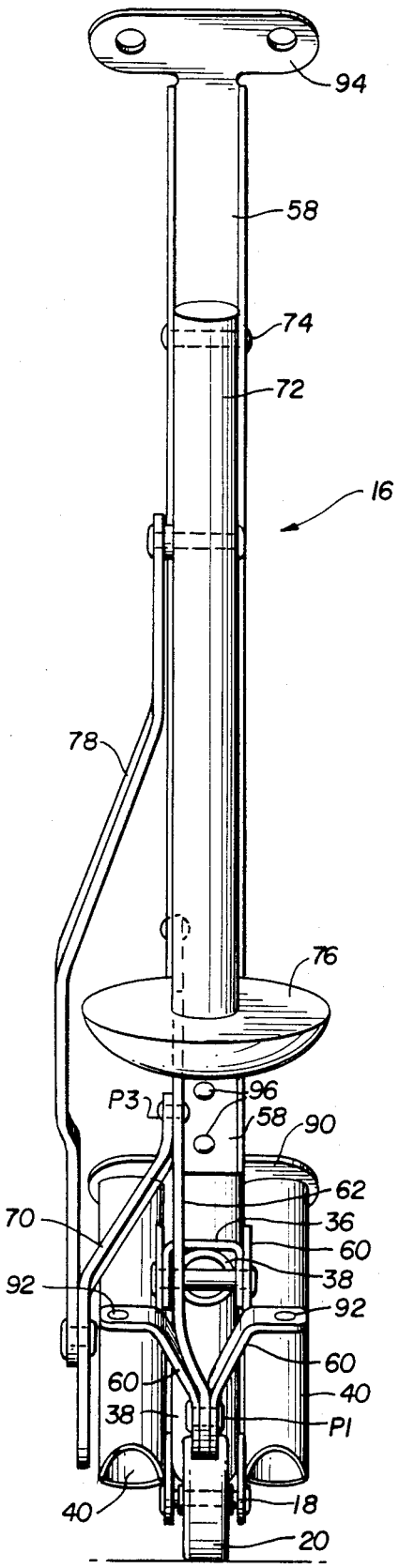
FIG. 10
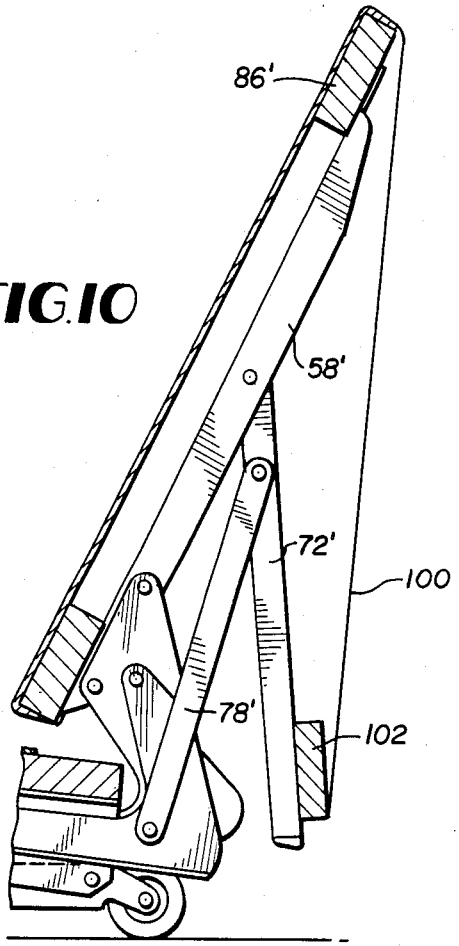
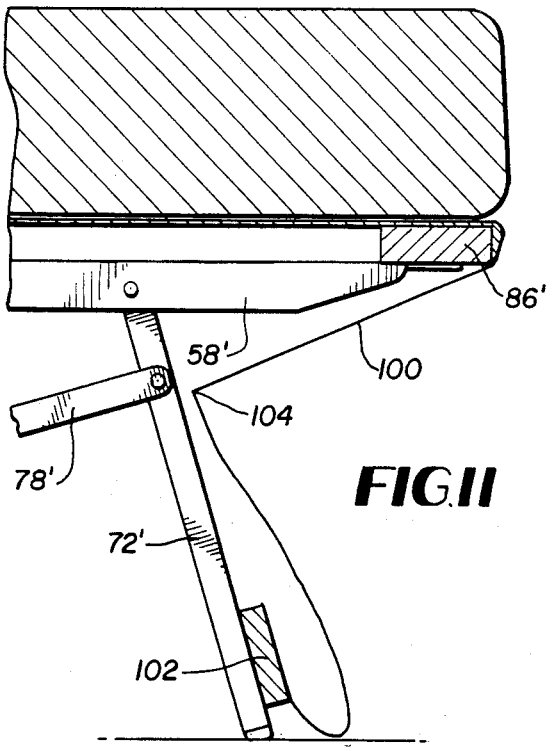
FIG. 11

FIG. 12
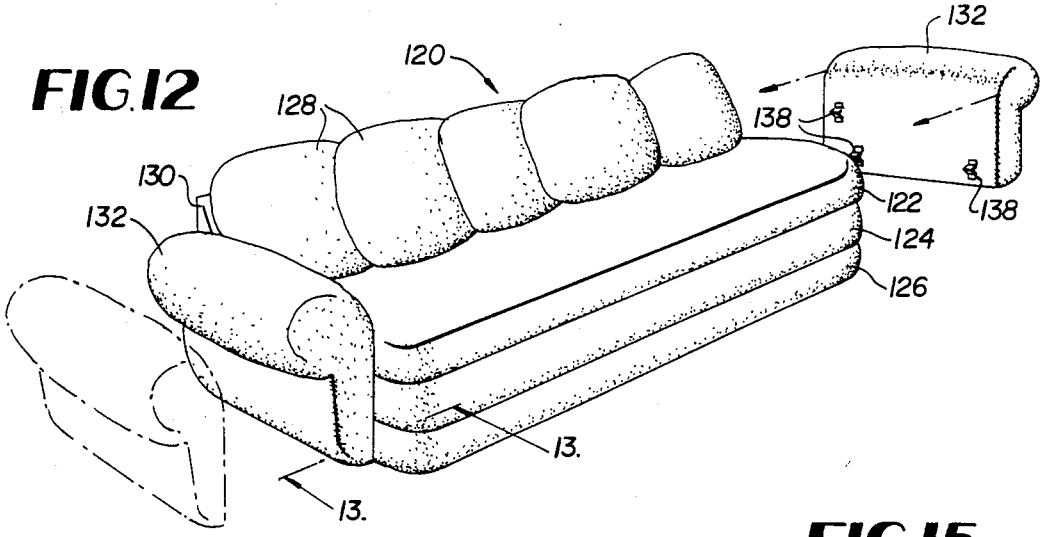
FIG. 15
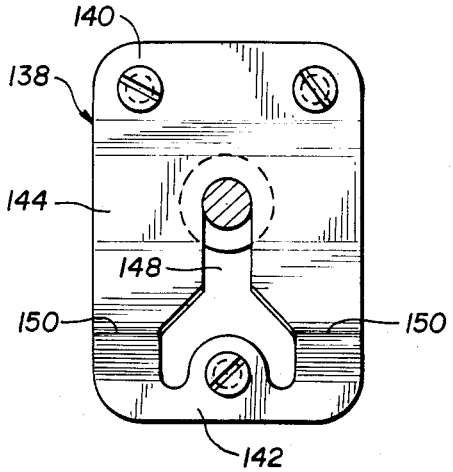
FIG. 13
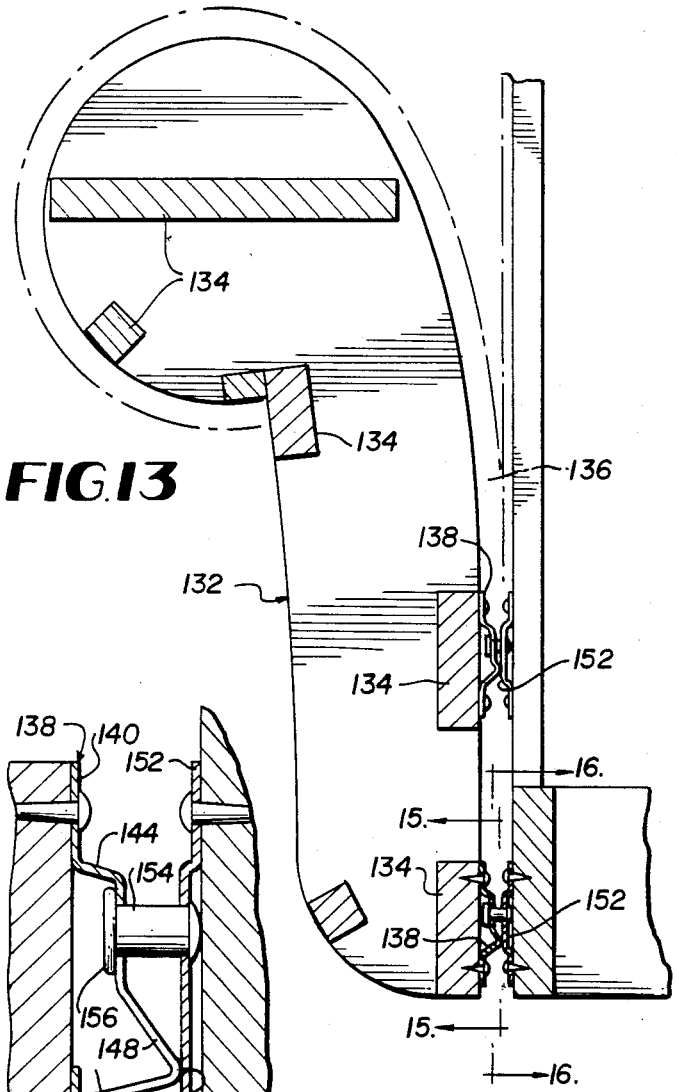
FIG. 16
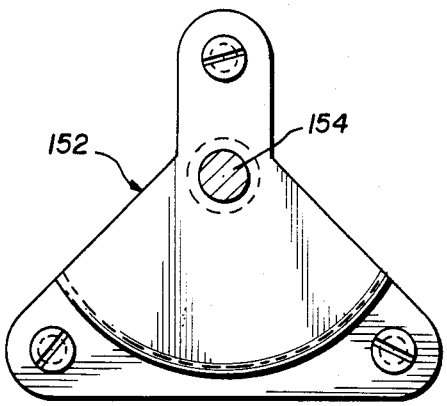
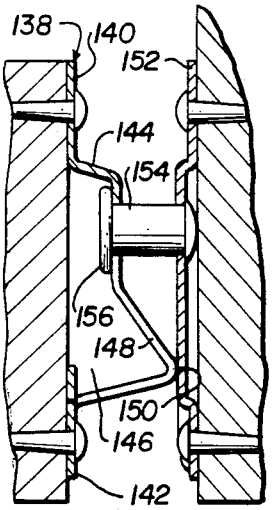
FIG. 14

ARTICLES OF FURNITURE AND COMPONENTS THEREOF

BACKGROUND OF THE INVENTION

This invention relates to furniture of the type which is convertible from a seating configuration to a sleeping configuration.

In the past, there have been many types of furniture pieces which are convertible from sleeping to seating configurations. Presently, most articles of furniture of this nature utilize foldout mechanisms which are mounted interiorly on the sides of a sofa frame, and a foldable deck is supported on the mechanism. Two mechanisms are required for each piece of furniture. These mechanisms are relatively complicated and mirror image left and right units are required.

A less complicated earlier type of furniture piece is the jackknife-type sofa bed in which the back is attached to the seat frame by a lockable hinge.

Another type of sofa bed, disclosed in Rogers, Jr. et al U.S. Pat. No. 3,657,747 of April 25, 1972, utilizes a linkage which is mounted on a stationary wooden base. The linkage moves a seat upwardly and forwardly while the back translates in a forward direction as it moves from an upstanding seating position to a horizontal sleeping position.

The present invention is believed to represent an improvement to the prior art of the type described above. In contrast to the jackknife-type sofa beds, this invention provides a relatively wide sleep surface, even in situations where the sofa or chair has a relatively low back.

The invention also makes it possible to construct a less complicated piece of furniture, as the mechanisms do not have to be attached to a frame. The mechanisms are self-supporting and they are capable of being mounted at locations which are inboard from the ends of the furniture piece, thereby providing for better support and better appearance in many cases.

The invention also is advantageous in the respect that the mechanism is less complicated than those used in foldout units. Fewer parts are utilized, and it is not necessary to provide left and right units which are mirror images of each other.

The invention also offers considerable versatility to the furniture designer and manufacturer. It may be used with wooden or metal frames, it can be used with or without an enclosing rear frame, and it is suitable in furniture pieces which are either provided with arms or are armless.

In addition to the attributes described above, the invention is quite simple, reliable and effective.

SUMMARY OF THE INVENTION

This invention relates to furniture which is convertible from a seating configuration to a sleeping configuration. In most respects, the invention is applicable to sofas, chairs and other pieces in which a seat support is moved from a lower seating position to an upper sleeping position, and a back support is moved from an upstanding seating position to a substantially horizontal sleeping position. The invention relates both to complete articles of furniture and to mechanisms which are embodied in such pieces of furniture.

In one respect, the invention involves the manner in which an article of furniture is supported on the floor or other support surface. Rather than having mechanisms connected to the arm frames of a furniture piece, a mechanism constructed according to the invention has its own base which is horizontally moveable as a unit to permit an article of furniture including the linkage to be moved forwardly before the back support is moved to its substantially horizontal sleeping position.

In another respect, the invention pertains to furniture and furniture components which provide a sleeping surface which is relatively wide with respect to the height of the seat back. In this regard, the back support member is pivotally moveable relative to the seat support member, and the pivot between these components is located so that the lower edge of the back support member moves rearwardly at least about three inches with respect to the seat support member when the back support member moves from its upstanding position to its horizontal sleeping position.

Additionally, the invention relates to an arrangement whereby a furniture piece is relatively stable both in its seating and sleeping positions. The seat elevating linkage includes a pair of scissors links which permit movement of the seat support from the lower seating position to the upper sleeping position. A first pivot provides pivotal movement of the back support member relative to the seat support member, and a back-lowering link is provided for moving the back support member to its sleeping position when the seat support member moves upwardly to its sleeping position. A link is pivotally connected at a second pivot to one of the scissors links and pivotally connected at a third pivot to the back support member. When the seat support member is in its lower seating position, the first pivot, i.e. the pivot between the back support and seat support members, is substantially lower than a line between the second and third pivots. However, when the seat support member is in its upper sleeping position, the first pivot is within one-half inch of a line between the second and third pivots. At this position, inadvertent movement of the members from their sleeping positions to their seating positions is prevented.

In another respect, the invention pertains to a cushion arrangement which can be used with a variety of convertible seating/sleeping pieces. A lower cushion lies on a seat frame, and an upper cushion is moveable from a seating position where it lies on a lower cushion to a sleeping position where it lies on the back frame when the back frame is in its horizontal sleeping position. The two cushions when in their seating positions have rear surfaces which are mutually parallel and are sloped upwardly and rearwardly. When the upper cushion is in its sleeping position, it is inverted from its seating position and it lies rearwardly of the lower cushion so that both cushions have substantially coplanar upper surfaces and they have their sloped surfaces in face-to-face relation to provide continuous support in the areas where the upper and lower cushions meet.

A further feature of the invention relates to a mechanism which has a particular type of scissors linkage for elevating the seat support member. The unit has a seat support member, a first link member and a horizontally moveable base, all of which are located in the same vertical plane. A second link means in the seat elevating linkage has a pair of parallel links which are located on opposite sides of the first link in order to provide symmetrical support of the seat support member with respect to the base. The links of the seat-elevating linkage are pivotally connected together at their midportions to provide a scissors-type movement.

In another respect, the invention relates to an article of furniture which is convertible from a seating configuration to a sleeping configuration, in which a side member is detachably connected to the seat support member and/or the back support member so that, after such detachment is made, the seat and back support members are able to move from their seating positions to their sleeping positions.

Another aspect of the invention involves an article of furniture in which there is a stationary frame assembly for receiving a forwardly moveable cushion-supporting assembly. The stationary frame has a back and two sides for enclosing the rear and sides of the cushion-supporting assembly when the back and seat support members thereof are in their seating positions. The cushion-supporting assembly is separable from the frame assembly so that it may move forwardly to permit the back support member to move from its upstanding seating position to its substantially horizontal sleeping position.

Further, the invention is applicable to an article of furniture which has its rear covered by a sheet of material. The sheet of material has an upper edge connected to the back support member, and it has its lower edge connected to a support leg which is carried by the back support member and is moveable from an extended floor-engaging position to a retracted position. The sheet is substantially flat when the back support member is upstanding and the support leg is retracted; however, the sheet of material is folded when the back support member is in its horizontal position and the leg is extended.

Another aspect of the invention pertains to an article of furniture in which two mechanisms each have a seat support member which is moveable from a lower seating position to an upper sleeping position. Each mechanism also has a back support member which is moveable from an upstanding seating position to a substantially horizontal sleeping position. According to this feature of the invention, the mechanisms, rather than being mirror image left and right mechanisms, are asymmetrical with respect to a plane located between them. Each mechanism has left and right sides which are different from each other but are substantially the same as the left and right sides of the other mechanism.

Another main feature of the invention pertains to furniture and furniture components in which a vertically moveable seat support and an inclinable back support have their movements controlled by a control link which connects the back support member to a scissors type of seat elevating linkage. The control link causes the seat support member to move from its lower seating position to its upper sleeping position when the back support member moves from its upstanding position to its substantially horizontal sleeping position. Preferably, the control link has a first portion which extends rearwardly from a seat-elevating scissors link; and, a second portion of the control link extends downwardly from its connection to the back support member. The first and second portions of the control link are connected together in an area which is located rearwardly of the seat support member.

The invention has a number of additional important features which will be recognized by persons skilled in the art and are set forth in the claims appended to this specification.

BRIEF DESCRIPTION OF THE DRAWINGS

FIG. 1 is a perspective view of a sofa constructed according to a first embodiment of the invention when in its seating configuration.

FIG. 2 is a perspective view of the sofa of FIG. 1, showing the cushion-supporting assembly moved to a forward position preparatory to being transformed to its sleeping configuration.

FIG. 6 is a rear view of the mechanism when in the configuration shown in FIG. 3.

FIG. 7 is an enlarged transverse sectional view taken through the base of the mechanism to show the support wheel of a unit.

FIG. 8 is a diagramatic sectional view showing details of elements which cooperate to stabilize the furniture piece shown in FIG. 1.

FIG. 9. is a sectional view taken along the line 9—9 in FIG. 8.

FIGS. 10 and 11 are somewhat diagramatic views showing an alternative form of the invention in which a sheet of fabric is used to cover the rear of the furniture piece. In FIG. 10, the unit is in its seating configuration, and in FIG. 11 it is in its sleeping configuration.

FIGS. 12–14 show a further embodiment of the invention in which detachable side members or arms are used for decorative and functional purposes. FIG. 12 is an exploded perspective view of the piece of furniture, FIG. 13 is a sectional view of an arm portion and adjacent frame portions thereof taken along the line 13—13 in FIG. 12, and FIG. 14 is an enlarged sectional view showing the brackets used to connect the arm to the back and seat supports.

FIGS. 15 and 16 are views taken along the lines 15—15 and 16—16 in FIG. 13, showing the two interconnecting brackets which are used in the furniture piece of FIGS. 12–14.

DETAILED DESCRIPTION

Figure 3:
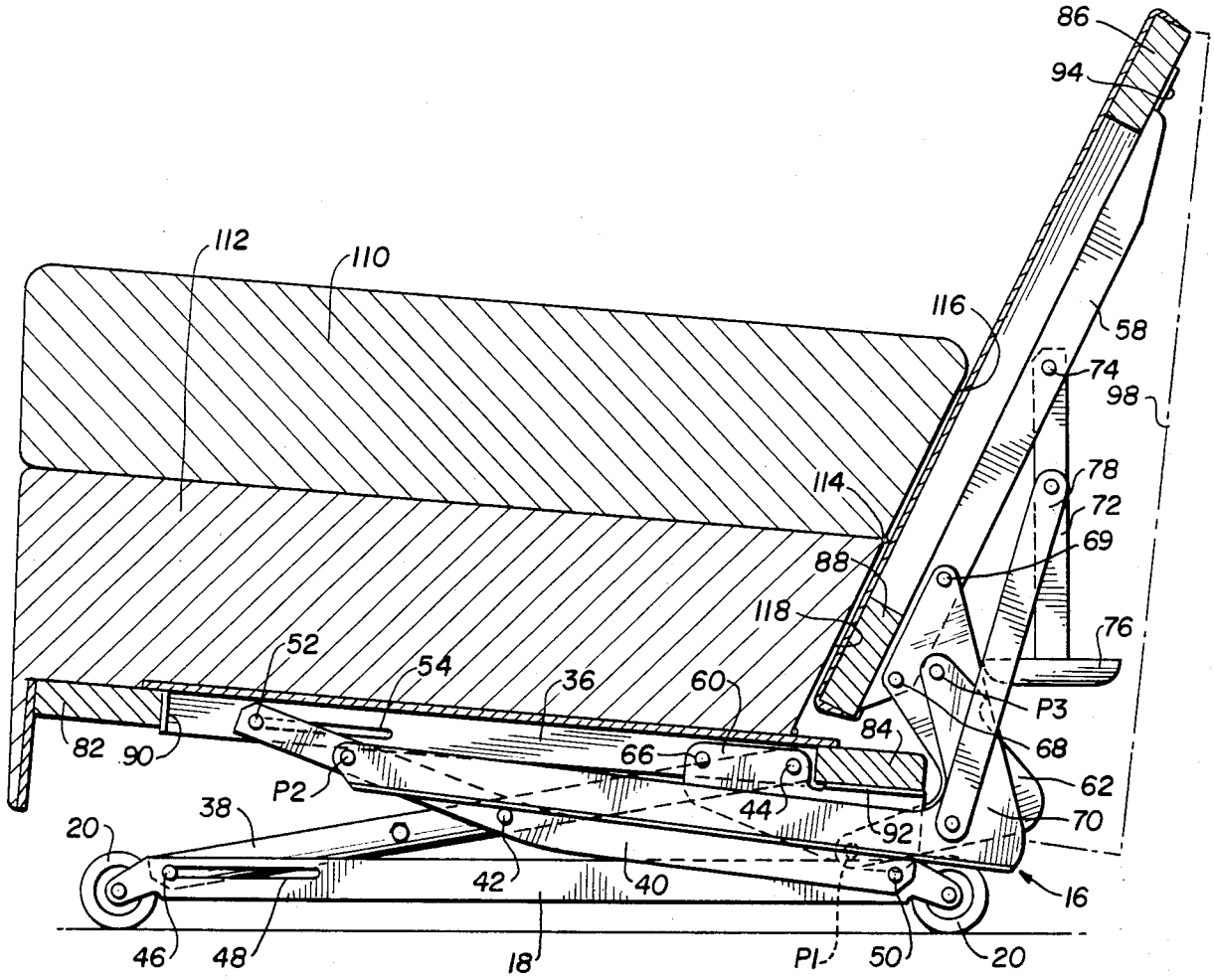
FIG. 3 is a side view showing a mechanism constructed according to the invention, wherein the components are in their seating configuration.

This invention relates primarily to chairs, sofas and other articles of furniture which are convertible from seating configurations to sleeping configurations by virtue of reclinable backs and elevatable seats.

One sofa 2 constructed according to the invention is shown in FIGS. 1 and 2. It has an upholstered main frame assembly 4 which is stationary, and a cushion-supporting assembly 6 which is moveable outwardly from the position shown in FIG. 1 to the position shown in FIG. 2. The stationary frame 4 has a back portion 8 and two arm portions 10 which normally enclose the rear and sides of the assembly 6 as shown in FIG. 1. The assembly 6 has a back frame 12 and a horizontal seat frame. A lower seat cushion 13 is affixed to and supported by the seat frame, and an upper cushion 15 is supported on the cushion 13. The back frame 12 supports loose cushions 14 when the unit is in its seating configuration. The back frame 12 is connected to the seat frame by two mechanisms 16, the details of which are described subsequently in connection with FIGS. 3–6.

In contrast to many furniture pieces which have mirror image left and right mechanisms connected to stationary side frames at the ends of a unit, the furniture pieces of this invention have identical left and right mechanisms 16 provided with bases 18 which are directly supported on the floor. The mechanisms are spaced inwardly from the opposite ends of the back and seat frames. The left and right sides of each mechanism 16 are different from each other, but they are substantially the same as the left and right sides of the other mechanism 16. Thus, the two mechanisms are asymmetrical with respect to a vertical plane which is located between them.

As shown in FIG. 7, the bases 18 of the mechanisms 16 are U-shaped channels which have wheels 20 supported on transverse shafts 22. These wheels facilitate the movement of the assembly 6 to the position shown in FIG. 2 where it is possible to move the back frame 12 downwardly to its horizontal position as will be described in subsequent portions of this specification.

To add stability to the unit when it is in the position shown in FIG. 1, the moveable assembly 6 is provided with means for holding down the forward portion of the stationary assembly 4. A preferred holddown means is illustrated in FIGS. 8 and 9. The arm portion of the stationary assembly has a bottom rail 24 which carries a holddown bracket 26. The bracket 26, also shown in FIG. 2, includes a flange 28 which has a slight rearward pitch and short ramps at its forward and rear ends. The seat frame of the moveable assembly 6 has a rail 30 which, as shown in FIG. 9, lies above the flange 28 when the assemblies are nested together. To reduce friction and abrasion, a slide plate is mounted on the lower surface of the rail 30. This slide plate has a rear ramp portion 32 and a forward holddown portion 34.

When the cushion-supporting assembly 6 is moved rearwardly from the position shown in FIG. 2 to the nested relationship shown in FIG. 1, the ramp portion 32 of the slide plate engages and rides up on the flange 28 of bracket 26 until the holddown portion 34 of the slide plate arrives at the position shown in FIG. 8. At this point, the forward part of the stationary frame 4 is held down by the rail 30 of assembly 6, and the rearward pitch of these members tends to deter incidental forward movement of the assembly 6. This deterrence, however, is insufficient to prevent forward movement of the assembly 6 when it is deliberately pulled forwardly.

The mechanisms 16 provide many of the important features of this invention. They may serve the multiple functions of supporting the furniture piece for forward horizontal movement, permitting the vertical movement of the seat so it may move from a lower seating position to an upper sleeping position, and enabling the back to move between an upstanding seating position and an substantially horizontal sleeping position. The mechanisms also can provide legs for supporting the back when it is in its sleeping position.

Most features of the mechanisms are best illustrated in FIGS. 3, 4, 5 and 6 where it will be seen that the base 18 of the unit is supported directly on the floor rather than being supported by furniture frame components. As previously mentioned, the wheels 20 are rotatably mounted on the base 18. Alternatively, glides, bearing slides or other movement facilitating means can be provided.

Figures 4, 5:
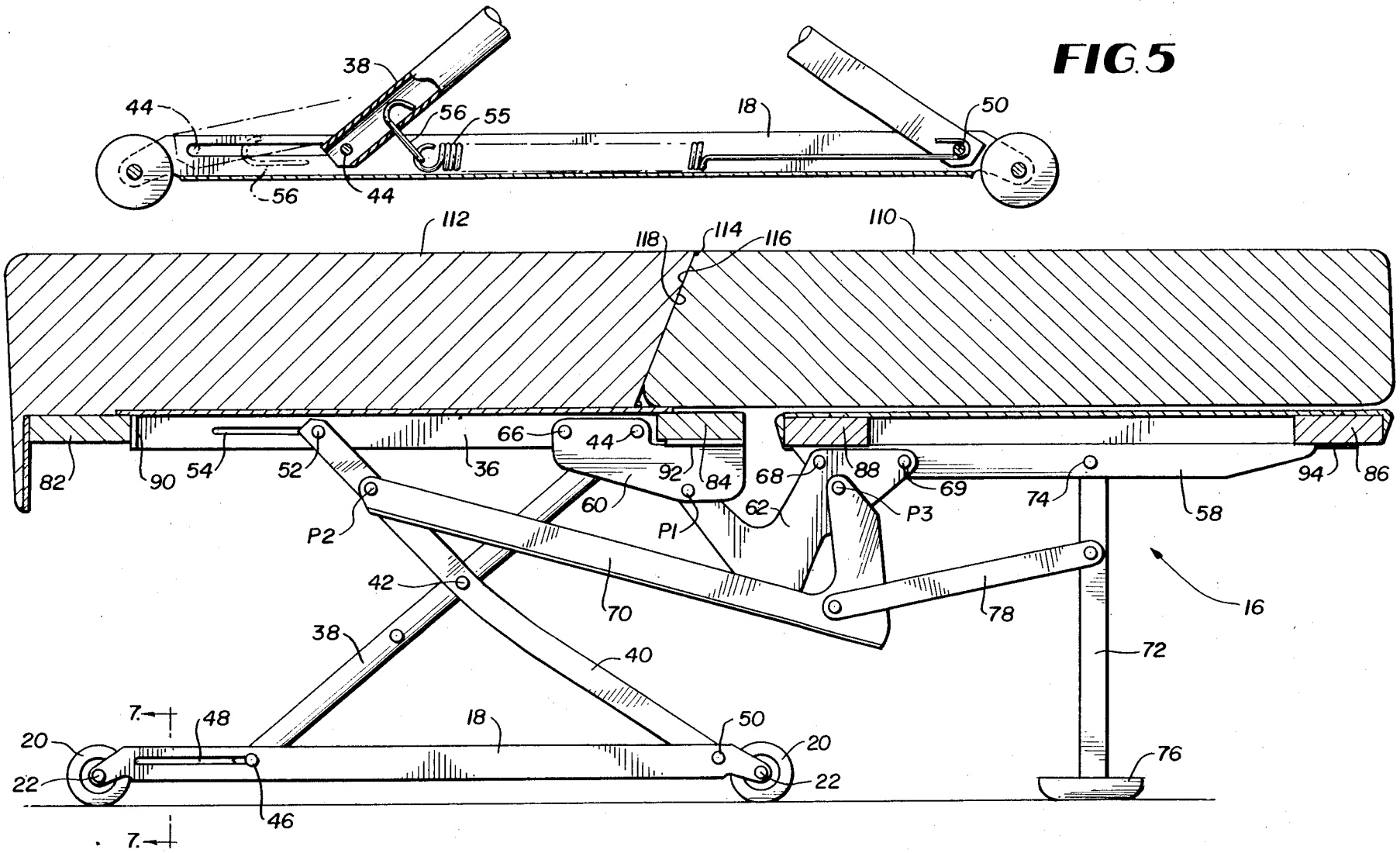
FIG. 4 is a view similar to FIG. 3, but showing the components of the mechanism in their sleeping positions.
FIG. 5 is a sectional view through the base of the mechanism showing a detail of the seat elevating booster spring.

A substantially horizontal seat support 36 is connected to the base 18 by a seat elevating linkage which permits the member 36 to move from the lower seating position of FIG. 3 to the upper sleeping position shown in FIG. 4. This linkage has tubular scissors links 38 and 40 which have their midportions pivotally interconnected at 42. As shown in FIG. 6, the link 38 is a single member which is in the same vertical plane as the base 18 and seat support 36. This provides the seat support member 36 with coplanar support with respect to the base member 18. There are two links 40 located on opposite sides of the link 38 to provide symmetrical support of the member 36 relative to the base 18. This relationship is best seen in FIG. 6. The link 38 has its rear end connected by pivot 44 to the seat support 36; and, its forward end is connected to the base 18 by a pin 46 which slides longitudinally in an elongated slot 48. The links 40 have their rear ends connected to the base 18 by a pivot member 50, and their forward ends are connected together by a transverse pin 52 which rides longitudinally in a slot 54. The effective lengths of links 40 are slightly greater than that of the link 38, so that vertical movement of the seat will also produce a slight angulation change between the slightly pitched orientation shown in FIG. 3 and the precise horizontal orientation shown in FIG. 4.

As can be seen in FIG. 5, a booster spring 55 is housed in the base 18 to assist the movement of the unit from its seating position to its sleeping position. This spring is confined so that it remains horizontal at all times. Its rear end is hooked over the pin 50, and its forward end is connected to the link 38 by a wire link 56. As shown in solid lines in FIG. 5, the spring 50 biases the link 38 in a direction which tends to move the seat upwardly. However, when the seat is moved to its lower position, the inclination of wire link 56 changes until is moves over-center to the position shown in broken lines. The link 56 then exerts a horizontal force on the link 38 at a point which is below the pin 46.

The back support member 58 is moveable from the upstanding seating position of FIG. 3 to the horizontal sleeping position of FIG. 4. The back support 58 and the seat support 36 are connected together by brackets 60 and 62 which are pivotally joined at P1. Two mirror image brackets 60 are riveted to the seat support 36 at 44 and 66, and the bracket 62 is riveted to the back support 58 at 68 and 69. The configuration of the brackets is such that the sleeping surface will be relatively wide with respect to the height of the back. In this respect, the pivot P1 is relatively low, preferably at least two inches below the upper surface of the seat support when the unit is in the position illustrated in FIG. 3. Due to the location of pivot P1, the lower edge of the back support will move at least about three inches rearwardly when the back support moves from the FIG. 3 position to the FIG. 4 position.

To coordinate the back and seat movements, the unit has a control link 70. This link 70 has a forward end connected to the scissors link 40 at P2, and a rear end connected to the back support 58 at P3. The link 70 is somewhat L-shaped which enables it to extend under and around the seat support 36 when the unit is in the condition shown in FIG. 3. The unit will remain securely in the seating configuration due to the weight on the seat. The pivot P1 is substantially lower than a straight line which extends between the pivots P2 and P3. When the unit is in the sleeping configuration of FIG. 4, pivot P1 is substantially aligned with a line between pivots P2 and P3, and this relationship will preclude the members from moving inadvertently from their sleeping positions to their seating positions. The axis of pivot P1 should be near or at an over-center toggle position. In this respect, P1 should not be more than about $\frac{1}{8}$ or $\frac{1}{2}$ inch off the line between the pivots P2 and P3. Ancillary latching means may also be provided to retain the unit in the seating and sleeping configurations.

When the unit is in the FIG. 4 sleeping position, a leg 72 provides supplemental support to the back support 58. The upper end of this leg 72 is pivotally connected to the rear of the back support 58 at 74. An enlarged foot 76 is mounted on the lower end of the leg 72. The leg 72 is moved and stabilized by a link 78 which has its opposite ends pivotally connected to the back control link 70 and the leg 72.

In the article of furniture, the seat and back supports are provided in part by a seat frame and a back frame. The seat frame has a front rail 82 and a rear rail 84, and the back frame has a top rail 86 and a bottom rail 88. The seat support and back support portions of the mechanism are connected to midportions of the seat and back frames, i.e. they are spaced inwardly from the opposite ends of the seat and back frames. The means facilitating these connections are shown in the drawings. For example, FIG. 4 shows that the member 36 has a forward vertical flange 90,and the brackets 60 on seat support 36 have rear horizontal flanges 92. The flange 90 is attachable to the front seat rail 82 by horizontally oriented wood screws, and the flanges 92 can be attached to the rear seat rail by vertically oriented wood screws. The member 58 has a forwardly facing upper flange 94 and lower holes 96, the location of the latter being shown in FIG. 6. The flange 94 and holes 96 receive wood screws which engage the upper and lower regions of the back frame.

The operation of the unit will be evident from the foregoing. Initially, the furniture piece is pulled out from the wall or frame 4. The front of the seat is grasped and lifted to raise the seat elevating linkage, thereby causing the control link 70 to lower the back. When the seat is fully raised, the alignment of the pivots P1, P2 and P3 are at a toggled or neartoggle condition so that the unit will be in a stable position.

To close the unit, the back support is lifted so that the line between the pivots P2 and P3 will move substantially above the pivot P1. In this condition, the seat support may be pushed downwardly to its lower seating position. When the unit is in the seating position, the weight on the seat will prevent any rearward movement of the back support.

In some circumstances, a supplemental back-lifting mechanism can be provided for lifting the back when closing the unit. Such a supplemental mechanism can be actuated from the front of the unit. For example, a concealed handle at the front of the sofa can be connected by a cable to a bell crank located in the interior of the furniture piece.

The furniture constructed according to the invention can have a plain or open back which exposes the mechanism, but it is usually preferred to provide some sort of concealment at the back of the unit. The stationary frame assembly 4 of FIGS. 1 and 2 obviously provides such concealment. Alternatively, the unit can have a tapered filler which has a thinner upper portion and a thicker lower portion. Such a filler may be a wooden frame, foam or other materials, and its shape may correspond to the broken line 98 shown in FIG. 3.

Another simple but effective arrangement for concealing the rear of the mechanism is shown in FIGS. 10 and 11. Here, the mechanism is essentially the same as shown in FIGS. 1–9, but the back-supporting leg 72' has a significantly smaller foot. Two such mechanisms are used. As shown in FIGS. 10 and 11, an upholstery fabric 100 is attached to the legs 72' by a rail 102. The rail 102 is connected to the legs 72' of both mechanisms by screws, staples or other fasteners. The fabric 100 extends upwardly to the top rail 86' of the back frame of the sofa. When the sofa is in the seating configuration illustrated in FIG. 10, the leg 72' is in its raised retracted position and the sheet of fabric 100 is under a slight tension which keeps it substantially flat. However, when the back support 58' moves to its substantially horizontal sleeping position, the leg 72' is extended by link 78' to engage the floor as shown in FIG. 11. The fabric thereby becomes folded in the illustrated manner where it continues to conceal the rear of the mechanism. A piece of fabric, string or other means may tie the fabric sheet 100 to the mechanism at 104 to hold a portion of the fabric above the floor at the orientation shown in FIG. 11.

A preferred cushion arrangement for use in connection with the invention is shown in FIGS. 3 and 4. The sofa in this case has an upper cushion 110 which is connected to a lower cushion 112 by a fabric hinge 114. In the condition shown in FIG. 3, the upper cushion 110 lies on the lower cushion 112, and the lower cushion lies on the seat frame. Both cushions have rear surfaces 116 and 118 which are sloped upwardly and rearwardly and lie in a common plane.

After the sofa mechanism is moved to the sleeping configuration shown in FIG. 4, the upper cushion 110 is inverted by turning it rearwardly about the fabric hinge 114. This places the upper cushion on the back frame where it is at the same elevation as the lower cushion. As shown in FIG. 4, the upper surfaces of both of these cushions are at the same elevation, and the sloped surfaces 116 and 118 are coplanar and abut each other to provide for continuous support in the area where the cushions 110 and 112 meet. The cushions 13 and 15 shown in FIGS. 1 and 2 are substantially the same as those in FIGS. 3 and 4 except that, in FIGS. 1 and 2, the lower seat cushion is placed in the same upholstery cover as the seat frame.

Another sofa construction according to the invention is shown at 120 in FIGS. 12–14. This piece has seat cushions 122 and 124 supported on an upholstered seat support 126, loose back cushions 128 which lean against a back support 130, and left and right side arm members 132 which are detachably connected to the seat and back supports. The seat and back members preferably are connected and supported by a mechanism of the type shown in FIGS. 3–6 so that the sofa can be moved away from a wall and transformed to the sleeping configuration.

The side members 132 provide arms for the sofa. Since they are connected both to the seat support and back support, they also prevent relative movement between the seat and back supports. Of course, when the arms 132 are detached from the sofa 120, they permit the seat and back to move from their seating positions to their sleeping positions.

As shown in FIG. 13 the arms have internal frame members 134, and an external layer 136 of compressible upholstery material such as foam, covered with an upholstery fabric. The detachable connection of the arms is provided by means of mating brackets 138 and 152. Three identical arm brackets 138 are mounted on each arm 132, and they are disposed where the two lower brackets 138 connect to the seat frame, and the upper bracket 138 connects to the back frame.

As can be seen in FIGS. 14 and 15, each arm bracket 138 is formed of a single piece of sheet metal which has upper and lower base portions 140 and 142 connected to the arm by screws. Each bracket also has a protruding midportion 144 which is separated from the arm by a space 146. The protruding midportion 144 of this bracket has an inverted Y-shaped slot 148 for receiving a pin of the mating bracket 152 as will be described below. To establish the minimum spacing between two interconnected brackets, the protruding portion 146 is bent to form an outermost spacer surface 150.

The brackets 152, shown in FIGS. 14 and 16, are mounted on the seat and back frames. They have a generally triangular configuration, and each of these brackets 152 has a base plate provided with a pin 154 which engages an arm bracket 138. As shown in FIG. 14, the head 156 of the pin 154 has a diameter which is greater than the width of the upper portion of slot 148 in bracket 138.

To attach an arm 132 to the back and seat supports of a sofa, the arm 132 is positioned where the slots 148 in bracket 138 are located above the pins 154 of brackets 152. The arm 132 is then lowered so that the slots move downwardly to the position shown in FIGS. 13 and 14. During this movement, the downwardly diverging edges of the Y-shaped slots 148 will act as cams to guide the slots into proper register with the pins 154. When the arm is in its final position, spacer surfaces 150 will bear against the base plate of brackets 152 to establish the minimum spacing between the interconnected members. The foam 136 or other compressible upholstery material between the interconnected members will bias the bracket members apart to provide a firm connection in the brackets. This will also provide frictional engagement of the upholstery fabric itself with the seat and back supports. However, the fit is such that the arms may be lifted and removed when they are subjected only to a moderate lifting force.

Persons familiar with the field of this invention will realize that the invention may take many forms, and that it is possible to use certain features of the invention apart from the other features thereof. Therefore, it is emphasized that the invention is not limited only to the disclosed embodiments but is embracing of a variety of structures which fall within the spirit of the following claims.

I claim:

1. A unit for making an article of furniture which is convertible from a seating configuration to a sleeping configuration, comprising, a base means which is operable to contact and move on a floor, said base means being supportable directly on said floor without the intermediary of an arm frame structure, a substantially horizontal seat support member located above the base means and having an upper surface, a seat elevating linkage connecting the base means to the seat support member, said linkage being operable to permit movement of the seat support member from a lower seating position to an upper sleeping position, an upstanding back support member which has a front and a rear, means for connecting the back support member to the seat support member, said connecting means being operable to permit inclining movement of the back support member from its upstanding position to a substantially horizontal sleeping position, said base means and the components connected thereto being horizontally movable as a unit to permit an article of furniture including said linkage to be moved forwardly before the back support member is moved to its substantially horizontal sleeping position, said elevating linkage being a scissors linkage which as a pair of scissor links which are pivotally interconnected and have their opposite ends connected to the base means and the seat support member, a spring for biasing said scissors linkage to move the seat support member to its upper sleeping position, said connecting means between the back support member and the seat support member including a first pivot which provides pivotal movement of the back support member relative to the seat support member, a back-lowering link means for moving the back support member from its upstanding position to its substantially horizontal sleeping position in response to movement of the seat support member from its lower seating position to its upper sleeping position, said back-lowering link means including a link which is pivotally connected at a second pivot to one of the scissors links and is pivotally connected at a third pivot to the back support member, said first pivot being substantially lower than a line between said second and third pivots when said seat support member is in its lower seating position, said first pivot being with ½ inch of a line between said second and third pivots when said seat support member is in its upper sleeping position to prevent inadvertent movement of the members from their sleeping positions to their seating positions.

2. A unit according to claim 1 wherein the first pivot has its axis located at least about 2 inches below the upper surface of the seat support member

3. A unit according to claim 1 having a support leg pivotally connected to said back support member at the rear thereof, and means for swinging the support leg out from said back support member in response to movement of the back support member to its substantially horizontal sleeping position.

4. A unit according to claim 3 wherein the means for swinging the support leg out from said back support member is a link which is pivotally connected both to the seat elevating linkage and to said back support member.

5. A unit according to claim 1 wherein the seat support member is provided with means for connecting it to a midportion of a seat frame means, and the back support member is provided with means for connecting it to a midportion of a back frame means.

6. A unit according to claim 5 wherein the means for connecting the back support member to the midportion of a back frame means includes a flange with a surface which faces forwardly when the back support member is in its upstanding position.

7. A unit according to claim 1 wherein said connecting means between the back support member and the seat support member includes a member which is rigidly connected to the back support member and connected by a pivot to the seat support member, said pivot being located at a location such that a lower edge of the back support member moves at least about 3 inches rearwardly when the back support member moves from the upstanding position to the substantially horizontal sleeping position to provide a sleeping surface which is relatively wide with respect to the height of the back.

8. A unit according to claim 1 in combination with a second said unit, a seat frame means for supporting seat cushions, said seat frame means having opposite ends, a back frame means for supporting back cushions, said back frame means having front and rear surfaces and opposite ends, said units being spaced apart and having their respective seat support members connected to said seat frame means, said units having their respective back support members connected to said back frame means.

9. The invention of claim 8 including a stationary furniture frame which has a back portion and two arm portions connected to said back portion, said base means supporting said back frame means and seat frame means for movement away from the back portion of said stationary furniture frame so that, after such movement, said back support member may be moved to its horizontal position without moving said stationary furniture frame.

10. The invention of claim 8 wherein said seat support members and said back support members are spaced inwardly from the opposite ends of said seat frame means and said back frame means.

11. The invention of claim 8 having a filler located on the rear surface of said back frame means, said filler being tapered to provide a thinner upper portion and a thicker lower portion thereof.

12. The invention of claim 8 having a lower cushion and an upper cushion, said lower cushion lying on the seat frame means, said upper cushion having a first position where it lies on the lower cushion when the seat support member is in its lower seating position, said upper cushion being movable to a second position where it is inverted from the first position and it lies on the back frame means when the back support member is in its substantially horizontal sleeping position, said lower cushion having a rear surface which is sloped upwardly and rearwardly, said upper cushion when in its first position having a sloped surface which is substantially coplanar with the rear surface of the lower cushion, said upper cushion when in said second position lying at the same elevation as said lower cushion and having its sloped surface abutting the rear surface of the front cushion to provide continuous support in the area where the first and second cushions meet.

13. The invention of claim 12 having a fabric hinge connecting together the upper and lower cushions.

14. A unit for making an article of furniture which is convertible from a seating configuration to a sleeping configuration, comprising, a substantially horizontal seat support member, a seat elevating linkage operable to permit movement of the seat support member from a lower seating position to an upper sleeping position, an upstanding back support member having a lower edge, first pivot means for providing pivotal movement of the back support member relative to the seat support member, said first pivot means being operable to permit movement of the back support member from its upstanding position to a substantially horizontal sleeping position, said first pivot means being located at a position such that the lower edge of said back support member moves at least about three inches rearwardly with respect to the seat support member when the back support member moves from the upstanding position to the substantially horizontal sleeping position to provide an article of furniture which in the sleeping position is relatively wide with respect to the height of its back, said seat elevating linkage including a pair of scissors links operable to permit movement of the seat support member from a lower seating position to an upper sleeping position, a back-lowering link means for moving the back support member from its upstanding position to its substantially horizontal sleeping position in response to movement of the seat support member from its lower seating position to its upper sleeping position, said back-lowering link means including a link which is pivotally connected at a second pivot to one of the scissors links and is pivotally connected at a third pivot to the back support member, said first pivot being substantially lower than a line between said second and third pivots when said seat support member is in its lower seating position, said first pivot being with ½ inch of a line between said second and third pivots when said seat support member is in its upper sleeping position to prevent inadvertent movement of the members from their sleeping positions to their seating positions.

15. A unit according to claim 14 wherein said seat elevating linkage includes a pair of scissors links operable to permit movement of the seat support member from a lower seating position to an upper sleeping position, a back-lowering link means for moving the back support member from its upstanding position to its substantially horizontal sleeping position in response to movement of the seat support member from its lower seating position to its upper sleeping position, said back-lowering link means including a link which is pivotally connected at a second pivot to one of the scissors links and is pivotally connected at a third pivot to the back support member, said first pivot being substantially lower than a line between said second and third pivots when said seat support member is in its lower seating position, said first pivot being within ½ inch of a line between said second and third pivots when said seat support member is in its upper sleeping position to prevent inadvertent movement of the members from their sleeping positions to their seating position.

16. A unit according to claim 15 wherein the first pivot is within ⅛ inch of said line between said second and third pivots when said seat support member is in its upper sleeping position.

17. A unit according to claim 15 wherein said seat elevating linkage includes a spring which is operable to bias said seat support member toward its upper sleeping position.

18. A unit according to claim 14 in combination with a second said unit, a seat frame means for supporting seat cushions, a back frame means for supporting back cushions, said units being spaced apart and having their respective seat support members connected to said seat frame means, said linkages having their respective back support members connected to said back frame means.

19. The invention of claim 18 wherein said seat frame means has opposite ends, said back frame means has opposite ends, and said seat support members and said back support members are spaced inwardly from the opposite ends of said seat frame means and said back frame means.

20. A unit for making an article of furniture which is convertible from a seating configuration to a sleeping configuration, comprising, a substantially horizontal seat support member, a seat elevating linkage including a pair of scissors links operable to permit movement of the seat support member from a lower seating position to an upper sleeping position, an upstanding back support member, means for connecting the back support member to the seat support member, said connecting means being operable to permit movement of the back support member from its upstanding position to a substantially horizontal sleeping position, said connecting means including a first pivot which provides pivotal movement of the back support member relative to the seat support member, a back-lowering link means for moving the back support member from its upstanding position to its substantially horizontal sleeping position in response to movement of the seat support member from its lower seating position to its upper sleeping position, said back-lowering link means including a link which is pivotally connected at a second pivot to one of the scissors links and is pivotally connected at a third pivot to the back support member, said first pivot being substantially lower than a line between said second and third pivots when said seat support member is in its lower seating position, said first pivot being within ½ inch of a line between said second and third pivots when said seat support member is in its upper sleeping position to prevent inadvertent movement of the members from their sleeping position to their seating position.

21. A unit according to claim 20 wherein the first pivot is within ⅛ inch of said line between said second and third pivots when said seat support member is in its upper sleeping position.

22. A unit according to claim 20 wherein said seat elevating linkage includes a spring which is operable to bias said seat support member toward its upper sleeping position.

23. A unit according to claim 20 in combination with a second said unit, a seat frame means for supporting seat cushions, a back frame means for supporting back cushions, said units being spaced apart and having their respective seat support members connected to said seat frame means, said linkages having their respective back support members connected to said back frame means.

24. The invention of claim 23 wherein said seat frame means has opposite ends, said back frame means has opposite ends, and said seat support members and said back support members are spaced inwardly from the opposite ends of said seat frame means and said back frame means.

25. A unit according to claim 20 wherein the back support member has a rear, said unit having a support leg pivotally connected to the back support member at the rear thereof, and means for swinging the support leg out from said back support member in response to movement of the back support member from its upstanding position to its sleeping position whereby said support leg provides support to the back support member when in its sleeping position.

26. A unit according to claim 20 wherein the back support member has a lower edge which moves at least about three inches rearwardly with respect to the seat support member when the back support member moves from its upstanding position to its sleeping position to provide a sleeping surface which is relatively wide with respect to the height of the back.

27. A unit for making an article of furniture which is convertible from a seating configuration to a sleeping configuration, comprising, a base means which is horizontally movable, a substantially horizontal seat support member located above the base means and lying in the same vertical plane as the base means, a seat elevating linkage connecting the base means to the seat support member, said linkage being operable to permit movement of the seat support member from a lower seating position which is substantially horizontal to an upper sleeping position which is substantially horizontal, a back support member which is movable from an upstanding seating position to a horizontal sleeping position, said seat-elevating linkage including a first link means and a second link means which have midportions which are pivotally connected together, said first link means having a forward end connected to the base means and a rearward end connected to the seat support member, said second link means having a forward end connected to the seat support member and a rearward end connected to the base means, one of said link means lying in the same vertical plane as the base means and the seat support member to provide coplanar support of the seat support member with respect to the base means, the other said link means comprising a pair of parallel links which are located on opposite sides of said one of said link means to provide symmetrical support of the seat support member with respect to the base means.

28. A unit according to claim 27 wherein the seat support member is provided with seat connection means for attaching the seat support member to a seat frame, said seat connection means lying on both sides of said vertical plane so the weight of said seat frame will be carried by said seat elevating linkage to avoid any torsional forces on the first and second link means.

29. A unit according to claim 27 in combination with a second said unit, a seat frame means for supporting seat cushions, a back frame means for supporting back cushions, said units being spaced apart and having their respective seat support members connected to said seat frame means, said linkages having their respective back support members connected to said back frame means.

30. The invention of claim 29 wherein said seat frame means has opposite ends, said back frame means has opposite ends, and said seat support members and said back support members are spaced inwardly from the opposite ends of said seat frame means and said back frame means.

31. An article of furniture which is convertible from a seating configuration to a sleeping configuration, said article of furniture having a seat support member and a back support member, said seat support member being movable from a lower seating position to an upper sleeping position, said back support member being movable from an upstanding seating position to a substantially horizontal sleeping position, a side member which is connected to the seat support member and the back support member when the article of furniture is in its seating configuration, said side member being operable to prevent relative movement between the seat support member and the back support member, said side member being detachabld from at least one of said seat support member and the back support member to permit their movement to said sleeping positions, a support leg connected to the back support member, and means for swinging the support leg out from the back support member in response to movement of the back support member to its substantially horizontal sleeping position, a seat elevating linkage connected to said seat support member, said means for swinging the support leg out from said back support member including a back-lowering link which is pivotally connected both to the seat elevating linkage and to said back support member, a first pivot which connects the back support member to the seat support member, said seat elevating linkage having a pair of scissors links for controlling the movement of the seat support member between its lower seating position and its upper sleeping position, said back-lowering link being pivotally connected at a second pivot to one of the scissors links and being pivotally connected at a third pivot to said back support member, said first pivot being substantially lower than a line between said second and thrid pivots when said seat support member is in its lower seating position, said first pivot being within ½ inch of a line between said second and third pivots when said seat support member is in its upper sleeping position to prevent inadvertent movement of the members from their sleeping positions to their seating positions.

32. An article of furniture according to claim 31 having bracket means for detachably connecting the side member to the seat support member and the back support member, said bracket means including an element which establishes a maximum spacing between the members, and compressible upholstery material on at least one of said members for biasing apart the members interconnected by the bracket to maintain the members at said maximum spacing.

33. An article of furniture according to claim 31 having a pivot which connects the back support member to the seat support member, said pivot having its axis located at least two inches below the upper surface of the seat support member.

34. An article of furniture according to claim 31 wherein the back support member has a lower edge which moves rearwardly at least about three inches with respect to the seat member when the back support member moves from its upstanding position to its sleeping position to provide a sleeping surface which is relatively wide with respect to its height.

35. An article of furniture which is convertible from a seating configuration to a sleeping configuration, said article of furniture having a frame assembly and a cushion-supporting assembly, said cushion-supporting assembly including a base member, a seat support member and a back support member, said base member being horizontally movable, said seat support member and said back support member being supported on said base member for horizontal movement therewith, said seat support member being movable relative to said base member from a lower seating position to an upper sleeping position, said back support member being movable relative to said base member from an upstanding seating position to a substantially horizontal sleeping position, said cushion-supporting assembly being located in said frame assembly, said frame assembly having a back frame and two side frames for enclosing the rear and sides of the cushion-supporting assembly when the back support member and seat support member are in their seating positions, said cushion-supporting assembly being separable from the frame assembly to permit forward horizontal movement of the base member relative to the frame assembly so that the back support member may move from its seating position to its sleeping position, said cushion-supporting assembly being provided with means for holding down a forward portion of the frame assembly when the cushion-supporting assembly is located within the frame assembly.

36. An article of furniture according to claim 35 having a pivot which connects the back support member to the seat support member, said pivot having its axis located at least two inches below the upper surface of the seat support member.

37. An article of furniture according to claim 35 wherein the back support member has a lower edge which moves rearwardly at least about three inches with respect to the seat member when the back support member moves from its upstanding position to its sleeping position to provide a sleeping surface which is relatively wide with respect to its height.

38. An article of furniture according to claim 35 having a support leg connected to the back support member, and means for swinging the support leg out from the back support member in response to movement of the back support member to its substantially horizontal sleeping position.

39. An article of furniture according to claim 38 having a seat elevating linkage connected to said seat support member, said means for swinging the support leg out from said back support member including a back-lowering link which is pivotally connected both to the seat elevating linkage and to said back support member.

40. An article of furniture according to claim 39 having a first pivot which connects the back support member to the seat support member, said seat elevating linkage having a pair of scissors links for controlling the movement of the seat support member between its lower seating position and its upper sleeping position, said back-lowering link being pivotally connected at a second pivot to one of the scissors links and being pivotally connected at a third pivot to said back support member, said first pivot being substantially lower than a line between said second and third pivots when said seat support member is in its lower seating position, said first pivot being within ½ inch of a line between said second and third pivots when said seat support member is in its upper sleeping position to prevent inadvertent movement of the members from their sleeping positions to their seating position.

41. An article of furniture which is convertible from a seating configuration to a sleeping configuration, said article of furniture having a seat support member and a back support member, said seat support member having an upper surface and being movable from a lower seating position to an upper sleeping position, said back support member being movable from an upstanding seating position to a substantially horizontal sleeping position, a support leg which is connected to the back support member, said support leg being movable from an extended floor-engaging position which it occupies when the back support member is in said sleeping position to a retracted position which it occupies when the back support member is in said upstanding seating position, and a sheet of material covering the rear of the article of furniture, said sheet having an upper edge connected to the back support member and a lower edge connected to said leg, said sheet being substantially flat when said leg is in its retracted position and being folded when said leg is in its extended position, a seat elevating linkage connected to said seat support member, said means for swinging the support leg out from said back support member including a back-lowering link which is pivotally connected both to the seat elevating linkage and to said back support member, a first pivot which connects the back support member to the seat support member, said seat elevating linkage having a pair of scissors links for controlling the movement of the seat support member between its lower seating position and its upper sleeping position, said back-lowering link being pivotally connected at a second pivot to one of the scissors links and being pivotally connected at a third pivot to said back support member, said first pivot being substantially lower than a line between said second and third pivots when said seat support member is in its lower seating position, said first pivot being within ½ inch of a line between said second and third pivots when said seat support member is in its upper sleeping position to prevent inadvertent movement of the members from their sleeping positions to their seating positions.

42. An article of furniture according to claim 41 having a pivot which connects the back support member to the seat support member, said pivot having its axis located at least two inches below the upper surface of the seat support member.

43. An article of furniture according to claim 41 wherein the back support member has a lower edge which moves rearwardly at least about three inches with respect to the seat member when the back support member moves from its upstanding position to its sleeping position to provide a sleeping surface which is relatively wide with respect to its height.

44. An article of furniture which is convertible from a seating configuration to a sleeping configuration, said article of furniture having a seat frame and a back frame which are supported by at least two mechanisms which each have a seat support member and a back support member, each of said seat support members having an upper surface and being movable from lower seating positions to upper sleeping positions, said back support members being movable from upstanding seating positions said mechanisms, rather than being mirror image left and right mechanisms, each having left and right sides which are different from each other but are substantially the same as the left and right sides of the other said mechanism, said mechanisms being asymmetrical with respect to a plane located between said mechanisms, a support leg connected to the back support member, and means for swinging the support leg out from the back support member in response to movement of the back support member to its substantially horizontal sleeping position, a seat elevating linkage connected to said seat support member, said means for swinging the support leg out from said back support member including a back-lowering link which is pivotally connected both to the seat elevating linkage and to said back support member, a first pivot which connects the back support member to the seat support member, said seat elevating linkage having a pair of scissors links for controlling the movement of the seat support member between its lower seating position and its upper sleeping position, said back-lowering link being pivotally connected at a second pivot to one of the scissors links and being pivotally connected at a third pivot to said back support member, said first pivot being substantially lower than a line between said second and third pivots when said seat support member is in its lower seating position, said first pivot being within ½inch of a line between said second and third pivots when said seat support member is in its upper sleeping position to prevent inadvertent movement of the members from their sleeping positions to their seating positions.

45. An article of furniture according to claim 44 wherein said seat and back frames have ends, and said mechanisms are spaced inwardly from the ends of said seat and back frames.

46. An article of furniture according to claim 44 having a pivot which connects the back support member to the seat support member, said pivot having its axis located at least two inches below the upper surface of the seat support member.

47. An article of furniture according to claim 44 wherein the back support member has a lower edge which moves rearwardly at least about three inches with respect to the seat member when the back support member moves from its upstanding position to its sleeping position to provide a sleeping surface which is relatively wide with respect to its height.

48. A unit for making an article of furniture which is convertible from a seating configuration to a sleeping configuration, comprising, a substantially horizontal seat support member, a seat elevating linkage including a pair of scissors links operable to permit movement of the seat support member from a lower seating position to an upper sleeping position, an upstanding back support member, means for connecting the back support member to the seat support member, said connecting means being operable to permit movement of the back support member from its upstanding position to a substantially horizontal sleeping position, a control link means for operatively connecting the back support member to the seat elevating linkage, said control link means being operable to control the movement of the seat support member and the back support member so that the seat support member moves from its lower seating position to its upper sleeping position when the back support member moves from its upstanding position to its substantially horizontal sleeping position.

49. An article of furniture having incorporated therein a unit according to claim 48.

50. A unit according to claim 48 wherein the control link means includes a control link which is pivotally connected to one of the scissors links and to the back support member.

51. A unit according to claim 50 wherein the control link has a first portion which extends rearwardly from its connection to one of the scissors links, said control link also having a second portion which extends downwardly from its connection to the back support member, said first and second portions of the control link being connected together in an area which is located rearwardly of the seat support member.

52. A unit according to claim 50 having a support leg pivotally connected to the back support member at the rear thereof, and a leg-operating link means which connects said control link to the support leg and moves the support leg to an extended floor-engaging position in response to movement of the back support member to its substantially horizontal sleeping position.

* * * * *